United States Patent [19]

Iwao

[11] 4,312,149

[45] Jan. 26, 1982

[54] TRANSFER MECHANISM UTILIZING A PIVOTABLE HOLDING MEMBER

[75] Inventor: Noriaki Iwao, Tokyo, Japan

[73] Assignee: Tomy Kogyo Co., Inc., Tokyo, Japan

[21] Appl. No.: 98,940

[22] Filed: Nov. 30, 1979

[51] Int. Cl.[3] ..... A63H 33/30; A63H 11/00

[52] U.S. Cl. ..... 46/40; 46/202; 46/123; 414/381

[58] Field of Search ..... 414/381, 382, 646, 648, 414/653, 658; 46/40, 39, 202, 123; 212/79-116

[56] References Cited

U.S. PATENT DOCUMENTS

| | | | |
|---|---|---|---|
| 706,521 | 8/1902 | Bruce | 414/381 |
| 3,721,035 | 3/1973 | Goldfarb | 46/40 |
| 3,738,057 | 6/1973 | Ogasawara | 46/40 |
| 3,793,746 | 2/1974 | Gagnon, Sr. | 46/40 |
| 4,100,696 | 7/1978 | Ogasawara | 46/40 |
| 4,128,964 | 12/1978 | Ogasawara | 46/40 |
| 4,150,507 | 4/1979 | Ogasawara | 46/40 |

FOREIGN PATENT DOCUMENTS

| | | | |
|---|---|---|---|
| G 18354 | 6/1956 | Fed. Rep. of Germany | 46/40 |
| 1002674 | 2/1957 | Fed. Rep. of Germany | 46/40 |

*Primary Examiner*—Gene Mancene
*Assistant Examiner*—Michael J. Foycik, Jr.
*Attorney, Agent, or Firm*—K. H. Boswell; Edward D. O'Brian

[57] ABSTRACT

A transfer mechanism for use in a toy of the type incorporating "ball people" figurines to transfer the figurines from one location to a second location includes a base radially displaced from both the first and the second locations and a carrier which is rotatably mounted on the base. The carrier includes a support member having a first end which is movable in an arc between the first and second locations and a holding member which is pivotally mounted on the first end of the support member. A platform is located at the second location and includes an edge capable of being engaged by a portion of the holding member. The holding member is capable of swinging about its pivot; then it engages the platform. The edge of the platform includes a guide and when the first end of the support member approaches adjacent the second location the guide engages the holding member tilting the holding member allowing a "ball person" to roll off of the holding member onto the platform.

10 Claims, 8 Drawing Figures

10

96
70
98
94
100
60
16
104
140
92
134
99
90
138
58
114
14
122
86
110
88
116
50
128
120
18
128
12
154
52
26
22
20

16
94
86
100
104
102
148
90
99
134
88
110
144

14
116
100
102
114
118
120
110
122

TRANSFER MECHANISM UTILIZING A PIVOTABLE HOLDING MEMBER

BACKGROUND OF THE INVENTION

A transfer mechanism for transferring an article from a first location to a second location utilizes a pivotally mounted article holder which upon engagement with the second location pivots to dispense the article at the second location.

A variety of toys are known which include small figurines characterized as people, animals, etc. Certain of these figurines are what can be classified as "ball people". These are small figurines having a body constructed to include a hollow bottom cavity wherein a rotatable ball is located. A portion of the ball extends out of the bottom of the body and the ball suspends the body from the surface and is rollable on the surface. Normally gravity will cause the figurine to roll upon its ball down a surface if the surface is inclined.

There are several toys which are known which utilize these "ball people". Among these are the toys described in U.S. Pat. No. 4,100,696 which is directed to a toy having an endless loop train and a wheel-like mechanism which will load a "ball person" onto the train. A second toy described in U.S. Pat. No. 4,150,507 also utilizes the "ball people" and includes a mechanism different from that described in the previously noted patent but similar in that it loads the "ball person" onto a moving vehicle. A third toy utilizing "ball people" is described in U.S. Pat. No. 4,128,964 and includes a mechanism which lifts a "ball person" up through the center of a tower and then deposits the "ball person" into a helicopter shaped carrier. The helicopter shaped carrier includes a trap door which can further deposit the "ball person" down a ramp and ultimately onto a movable train-like vehicle which circles the tower on an endless track. The disclosures of U.S. Pat. Nos. 4,100,696; 4,150,507; and 4,128,964 are incorporated herein by reference.

Because of the physical appearance and the ability of the "ball people" to move the above noted toys are very interesting to the preschool-age child. The movement of the "ball people" in these toys encourages the child to investigate how the toys effect such movement and thus can educate the child and stimulate his mental development. Because of the acceptance of these "ball people" type toys as both a plaything and as a mental stimulus it is considered that other toys utilizing different mechanisms for movement of the "ball people" would also be effective in teaching a child and are thus highly desirable.

SUMMARY OF THE INVENTION

It is an object of this invention to provide a toy which utilizes the "ball people" concept but which incorporates a transfer mechanism unknown in the presently available "ball people" toys. This mechanism is based on a pivotal basket-like member which is carried from one location to a second location by a support member. It is a further object to provide a stimulating toy which is also easily manufactured, and durable in construction and operation.

These and other objects are achieved by providing a transfer mechanism for moving an article from a first location to a second location which comprises: a base displaced from both the first and the second location and a carrier means movably mounted on the base such that at least a portion of the carrier means is capable of moving from the first location to the second location, said carrier means includes a support member and an article holding member, said support member having a first end movable from at least a position adjacent to said first location to a position adjacent to said second location, said article holding member including a surface capable of supporting the article within the article holding member, a wall means projecting upwardly from the surface and capable of maintaining the article on said surface and an opening through the wall means and located over a portion of the surface and sized to allow the article member to reversibly pass through the opening over said portion of said surface onto and off of the surface; a pivot means pivotally attaches the article holding member to the first end of the support member such that the portion of the surface below said opening is movable in respect to the second location toward and away from said second location; a platform is located at the second location and the platform includes an edge having a portion thereof capable of engagement with the article holding member; the article holding member operatively engaging the edge as the first end of the support member moves adjacent to the second location causing the article holding member to pivot about the pivot means inclining the surface such that the portion of the surface below the opening is lower than the remainder of the surface and discharging the article from the surface of the article holding member through the opening in the article holding member.

In the preferred embodiment the first and second locations are radially displaced from the base and the carrier is rotatably mounted on the base such that the first end of the support member moves through an arc as it moves between the first and second location. A drive means is operatively associated with the base and rotates the carrier means on the base. A guide means is located on the edge of the platform and is capable of guiding the article holding member along the edge. The article carrier means includes an upright member having a cam located in its interior. The second end of the support member distal from the first end is pivotally mounted in the upright member and includes a cam follower. The cam follower engages the cam which is fixedly held with respect to the base. As the upright member turns with respect to the base interaction of the cam follower with the cam pivots the support member with respect to the upright member causing the first end of the support member to move through a vertical displacement. Since the article holding member is attached to the first end of the support member it also is vertically displaced.

The article holding member is preferably constructed to include a flat surface having an upstanding U shaped wall located on the flat surface such that the break between the ends of the U shaped wall forms the opening in the holding member. The U shaped wall in turn is suspended by a plurality of suspending members attaching to the pivot means. Together these components form a suspended chair-like structure capable of discharging the article through the opening when the flat surface is displaced from vertical such that the opening is downwardly directed or oriented.

BRIEF DESCRIPTION OF THE DRAWINGS

This invention will be better understood when taken in conjunction with the drawings wherein.

This invention utilizes certain principles and/or concepts as are set forth and defined in the claims appended to this specification. Those skilled in the arts to which this invention is directed will realize that these principles and/or concepts can be utilized in a number of differently appearing and differently constructed embodiments. For this reason this invention is to be construed in light of the appended claims and is not to be construed as being expressly limited to the embodiment shown in the figures and described in the specification.

DETAILED DESCRIPTION

Prior to describing mechanical components of this invention a brief pictorial discussion of how the toy which utilizes this invention works will better enable understanding of the mechanical aspects of the invention. For this brief description the components described will not be numbered but will be described using their outward appearance.

Figure 1:
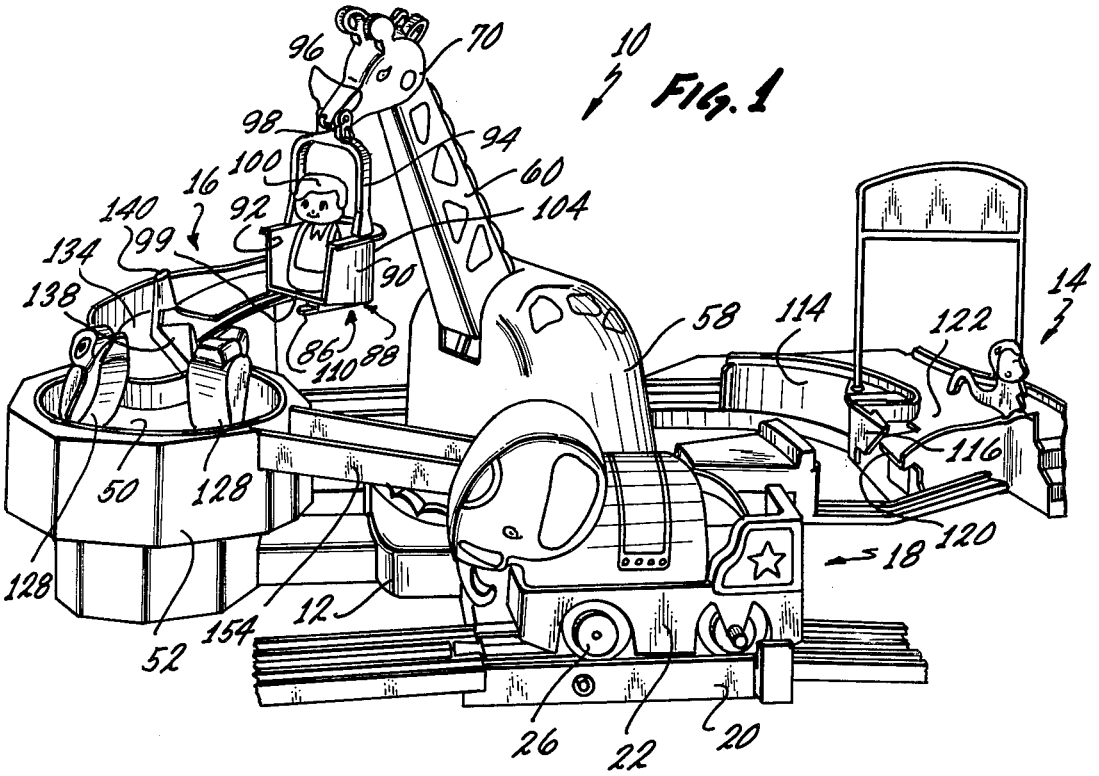
FIG. 1 is an oblique view of the components of the invention and of other associated parts useful with these components but not forming a part of this invention.

Referring to FIG. 1 central in the figure is a giraffe-like figure having what could be described as an oversized bucket seat suspended from its nose. In the bucket seat a small "ball person" is located. As the giraffe rotates clockwise the bucket seat engages a platform located on the left-hand side directly above the bird-like figurines. The ball person is discharged from the bucket seat, rolls down the ramp and is rotated along with the bird-like figurines about the poly-sided structure shown on the left-hand side. The ball person then descends down the ramp located between the poly-sided structure and the elephant-like vehicle. The ramp discharges the ball person into the elephant-like vehicle. The elephant-like vehicle then circumvents this structure by traveling around a track (not shown) until it is located adjacent to the structure on the right-hand side wherein the small monkey is located. The ball person is discharged from the elephant vehicle by a mechanism not forming a part of this invention and travels down a ramp through the upright arch-like structure, passes the monkey and becomes lodged against a gate located down from and slightly to the left of the monkey. The giraffe rotates clockwise and picks the ball person up in front of the gate. The giraffe then continually rotates until it is in the position shown in FIG. 1 wherein the sequence can be repeated. Power for operation of the giraffe is via a linkage which couples with the elephant vehicle. The elephant vehicle has a small battery powered motor in its interior which engages with a drive when the elephant vehicle is in the location shown in FIG. 1.

Referring now to the mechanical aspects the toy 10 has a base 12 which is located between a loading platform 14 and an unloading platform 16. A third platform 18 is also associated with the base 12. The third platform 18 couples with a track 20, a portion of which is shown in FIG. 1, which circumvents all of the above noted components and a portion of which is integrally formed with unloading platform 16. A powered vehicle 22 rides on track 20.

Located on the bottom side of third platform 18 are a set of pinions collectively identified by the numeral 24 a portion of which are exposed through the upper side of the track 20. When vehicle 22 is located over third platform 18 the power wheels 26 of the vehicle 22 engage with the pinions 24 and rotate the pinions 24 which in turn rotate axle 28 which extends from third platform 18 to base 12. A third pinion 30 located on axle 28 on the underside of base 12 engages with a crown gear 32. Crown gear 32 is positioned on an axle 34 but is free to rotate independent of it. Integrally formed with crown gear 32 is a pinion 36 which meshes with a spur gear 38 having a set of crown gear teeth 40 integrally formed with it. Crown gear 40 meshes with pinion 42 which drives axle 44. On the other end of axle 44 is pinion 46 which meshes with crown gear 48 which in turn rotates transfer table 50 which is located on the upper surface of poly-sided housing 52. Fixedly attached to axle 34 is a spur gear 54 which meshes with a pinion 56 located on the top side of spur gear 38. Spur gear 54 drives axle 34.

Figure 3:
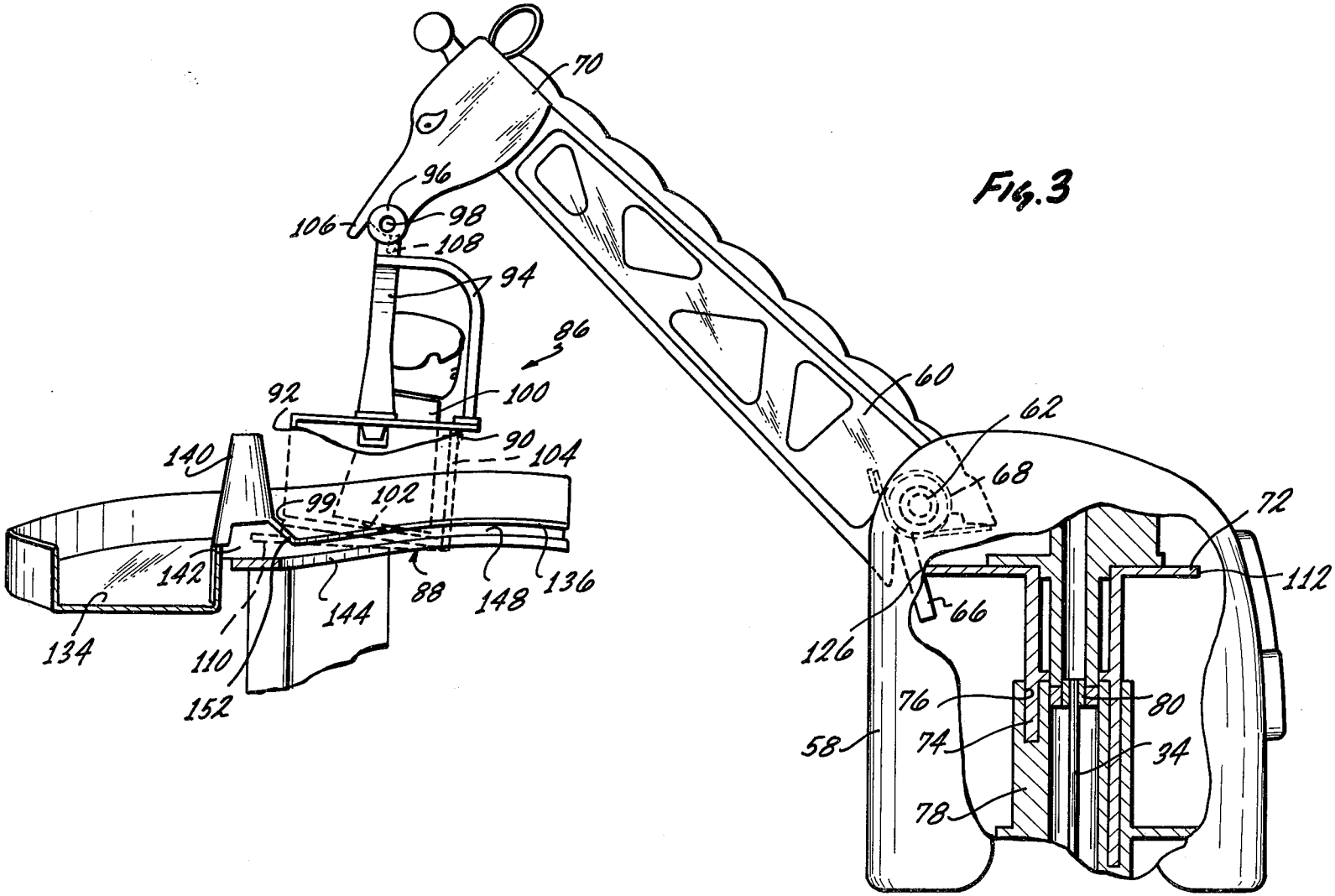
FIG. 3 is a side elevational view in partial section of the components of this invention which are found generally in the center and to the left of center of FIG. 1.
Figure 8:
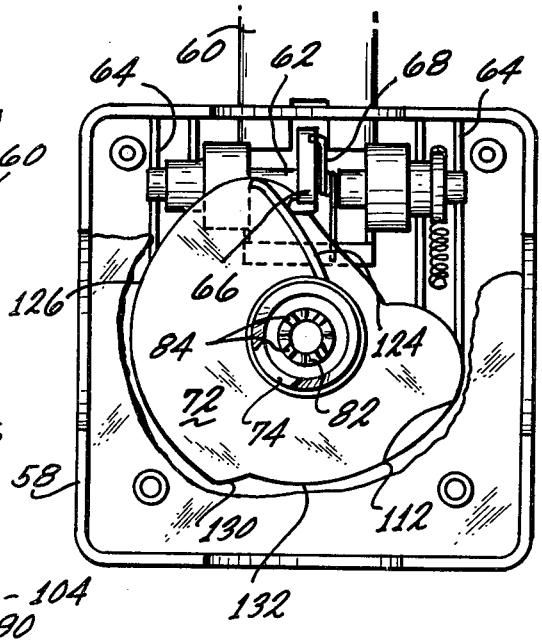
FIG. 8 is a bottom plan view of those components shown on the right-hand side of FIG. 3.

Rotatably mounted on the upper surface of base 12 is an upright housing 58 shaped as the body of a giraffe in the illustrated embodiment. Projecting from the upper surface of housing 58 is a support member 60 shaped as the neck and head of the giraffe. As seen in FIG. 3 and FIG. 8 the support member 60 is pivotally mounted to the upright housing 58 via an axle 62 fitting within bearing surfaces 64 integrally formed within the interior of upright housing 58. Located on the center of axle 62 is a cam follower 66. Cam follower 66 is biased by spring 68 into a position as shown in FIG. 8. Spring 68 serves as an override should the end 70 of support member 60 be inadvertently depressed while the cam follower 66 was locked against a cam as hereinafter described. Spring 68 is of sufficient tension to transfer movement from cam follower 66 to support member 60 but will give if the cam follower 66 is locked and the support member 60 is moved.

A cam 72 is fixedly held by a tab 74 which locks into a slot 76 formed in an upstanding boss 78 integrally formed with base 12. Neither the boss 78 nor the cam 72 are free to rotate. Extending upwardly through the center of boss 78 is axle 34. A crown gear 80 is located on axle 34 within the interior of boss 78. A drive member 82 keyed to the top of upright housing 58 fits downwardly within the interior of boss 78. Located on the lowermost end of drive member 82 are a set of crown teeth 84 which match and lock with crown gear 80. Rotation of axle 34 is transferred to crown gear 80 and in turn to crown teeth 84. Since crown teeth 84 are fixedly locked to drive member 82 which in turn is keyed to upright housing 58 causing it to rotate about both upstanding boss 78 and cam 72 fixedly locked to boss 78. As the upright housing 58 rotates cam follower 66 follows the cam surface on cam 72 transferring motion to support member 60. Because of the shape of cam 72 the end 70 of support member 60 rises and falls in a pattern dependent upon the pattern of the cam 72 as hereinafter described.

An article holding member 86 is pivotally attached to end 70 of support member 60. The article holding member 86 has a generally flat bottom surface 88 surrounded by a U shaped wall 90. The break between the ends of the U shaped wall 90 form an opening 92. Three suspension members collectively identified by the numeral 94 extend upwardly and then inwardly from the top of U shaped wall 90. At the top of the suspension members 94 are two upstanding bearings collectively identified by the numeral 96. Two pins 98 collectively identified by the numeral 98 extend outwardly from the nose portion of the support member 60 and the bearing members 96 fit over these pins 98 pivotally attaching the article holding member 86 to the end 70 of support member 60.

Figure 6:
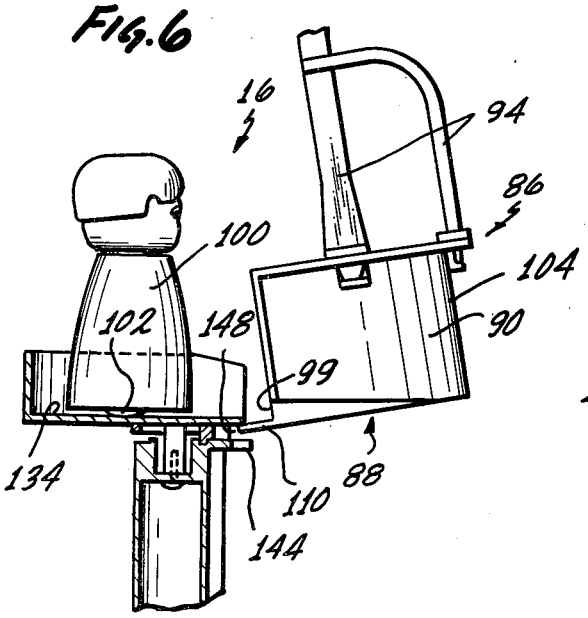
FIG. 6 is a side elevational view of certain of the components shown in FIGS. 3, 4 and 5 after one of the components has been repositioned with respect to another of the components.
Figure 4:
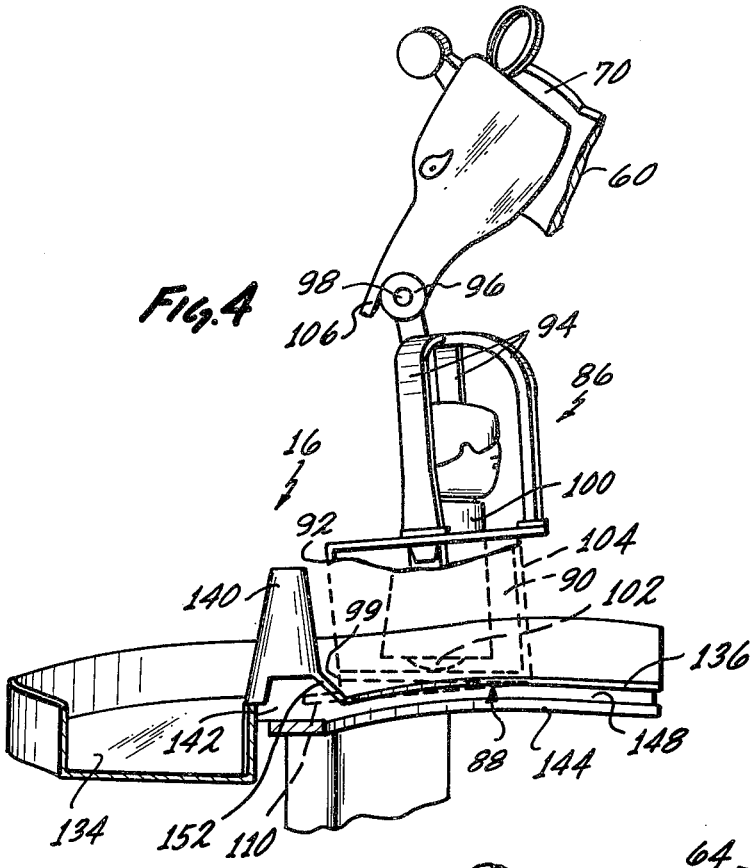
FIG. 4 is a side elevational view of certain of the components illustrated in FIG. 3 showing them in a different spatial relationship.
Figure 5:
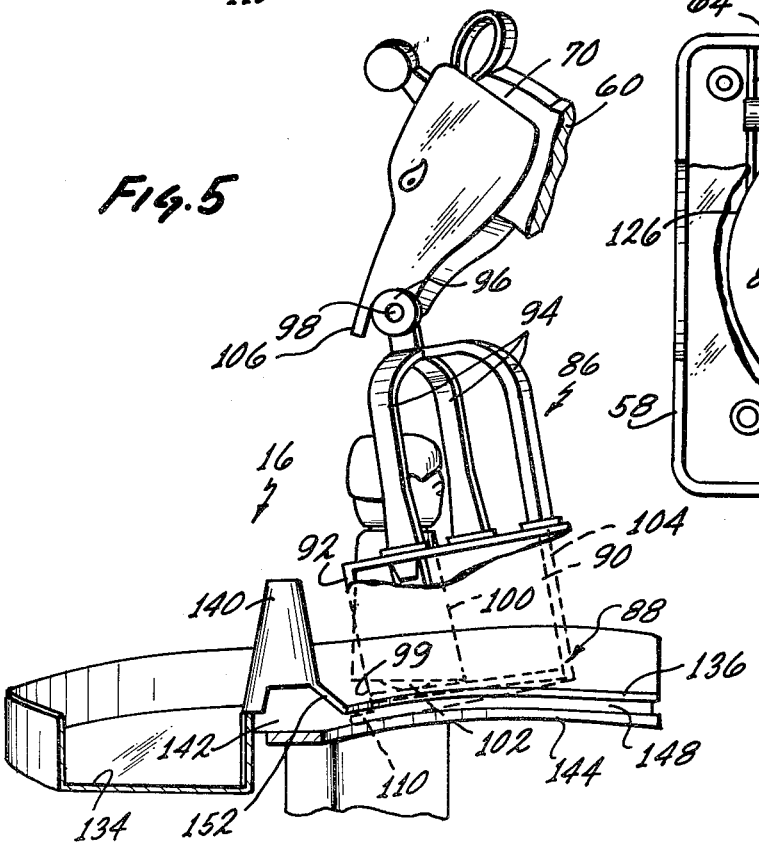
FIG. 5 is a figure similar to FIG. 4 except the components are shown in yet another spatial relationship.

The article holding member 86 is free to swing about end 70 of support member 60 in a line extending outwardly from the base along the horizontal projection of support member 60. This allows the edge or portion 99 of article holding member 86 directly below opening 92 to swing toward and away from the unloading platform 16 which in turn tilts or inclines surface 88 with respect to a horizontal plane. As a consequence of this as seen in the sequence shown in FIGS. 3 to 6 the opening 92 is first slightly oriented upwardly in FIG. 3, almost vertically oriented in FIG. 4 and finally is slightly downwardly oriented in FIGS. 5 and 6.

A ball person 100 has a small ball 102 located in a hollow bottom cavity (not numbered or shown) which allows the ball 102 to rotate within the cavity and serve as a movable support for the ball person 100 allowing the ball person 100 to move across a surface. The ball person 100 can fit within the opening 92 and be held within the article holding member 86. When the ball person 100 is to the rear of curved section 104 of the article holding member 86 the weight of the ball person 100 is displaced as shown in FIG. 3 to the right of the center of gravity of the article holding member 86. Again as shown in FIG. 3 this causes the article holding member 86 to pivot or swing slightly to the left (counterclockwise) and displaces the flat bottom surface 88 away from the horizontal such that the opening 92 is somewhat upwardly directed or oriented. This holds the ball person 100 securely within the article holding member 86. When as hereinafter described the article holding member 86 is tilted such that the flat bottom surface is displaced from the horizontal and the opening 92 is somewhat downwardly directed or oriented the ball person 100 will roll toward the opening 92 and out of the article holding member 86.

A fore and aft limit stop 106 and 108, respectively, located on the end of the nose portion of support member 60 limits the amount of travel or swing of the article holding member 86 about the support member 60. When the end 70 of support member 60 is almost vertical the limit stop 108 engages a portion of the suspension members 94 further tilting the opening 92 of the article holding member 86 upwardly causing a ball person 100 located within the article holding member 86 to be even more securely held against the curved section 104 in the article holding member 86. An engagement lip 110 extends from the bottom of flat surface 88 outwardly in the direction of opening 92.

Figure 7:
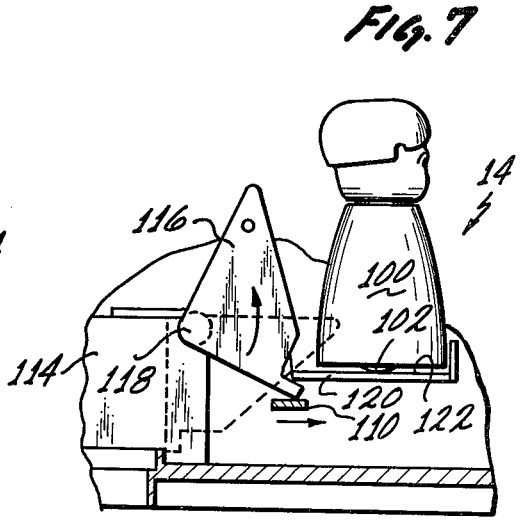
FIG. 7 is a side elevational view in partial section of certain of the components found on the right-hand side of FIG. 1 which although they are not part of this invention are necessary to the understanding of the operation of this invention.

As viewed in FIG. 1 the upright housing 58, support member 60, and the article holding member 86 all move as a unit in a clockwise direction by motion transferred via the vehicle 22 when it is located on third platform 18 by the gearing and axles as hereinbefore described. When the holding member 86 clears the unloading platform 16 cam follower 66 is turned around cam 72 about cam surface 112. This allows the cam follower 66 to descend toward the center of the upright housing 58 and lowers the end 70 of support member 60 and consequently the article holding member 86. The article holding member 86 comes by wall 114 on loading platform 14. A ball person 100 stationed on loading platform 14 near gate 116 as shown in FIG. 7 can then be loaded into article holding member 86 as follows: Gate 116 is pivoted about its upper left-hand side by an axle 118 fitting into an appropriate bearing surface (not numbered or shown) on loading platform 14. As the article holding member 86 goes by wall 114 in a clockwise direction engagement lip 110 engages the bottom of the gate 116 and further clockwise movement of the article holding member 86 causes the gate 116 to rotate in a counterclockwise direction about axle 118. This lifts the gate 116 upwardly and to the left allowing a ball person 100 to be discharged from loading platform 14 into article holding member 86. Engagement lip 110 is maintained underneath the end 120 of the loading ramp 122 on loading platform 14. This ensures positioning of the article holding member 86 against the loading platform 14 until the article holding member 86 has completely cleared the loading platform 14. After the engagement lip 110 is freed from gate 116 the gate 116 descends in a clockwise manner preventing any other ball person 100 on the loading platform 14 to descend off the loading ramp 122.

Continued clockwise rotation of the upright housing 58 and the other components attached thereto brings cam follower 66 across surface 124 of the cam 72 until the cam follower 66 engages surface 126 on the cam 72. Movement of cam follower 66 across surface 124 pushes the cam follower 66 away from the center of upright housing 58 and consequently raises end 70 and the article holding member 86 and the ball person 100 located therein in an upward direction. During this upward movement the ball person 100 is resting against curved section 104 and near the upper limit of this upward travel limit stop 108 engages suspension members 94 further ensuring maintaining the ball person 100 in the article holding member 86. As the cam follower 66 goes across surface 126 on cam 72 the article holding member 86 is suspended high enough to clear figurines collectively identified by the numeral 128 located on the transfer table 50 of poly-sided housing 52.

As the article holding member 86 approaches the unloading platform 16 the cam follower 66 goes across surface 130 on cam 72 which causes, in a like manner as hereinbefore described, article holding member 86 to descend slightly. When cam follower 66 has just cleared surface 130 and engages with surface 132 of cam 72 the components of the toy 10 are located as shown in FIG. 3. Unloading platform 16 includes a platform 134 having an edge 136 which is slightly curved.

Figure 2:
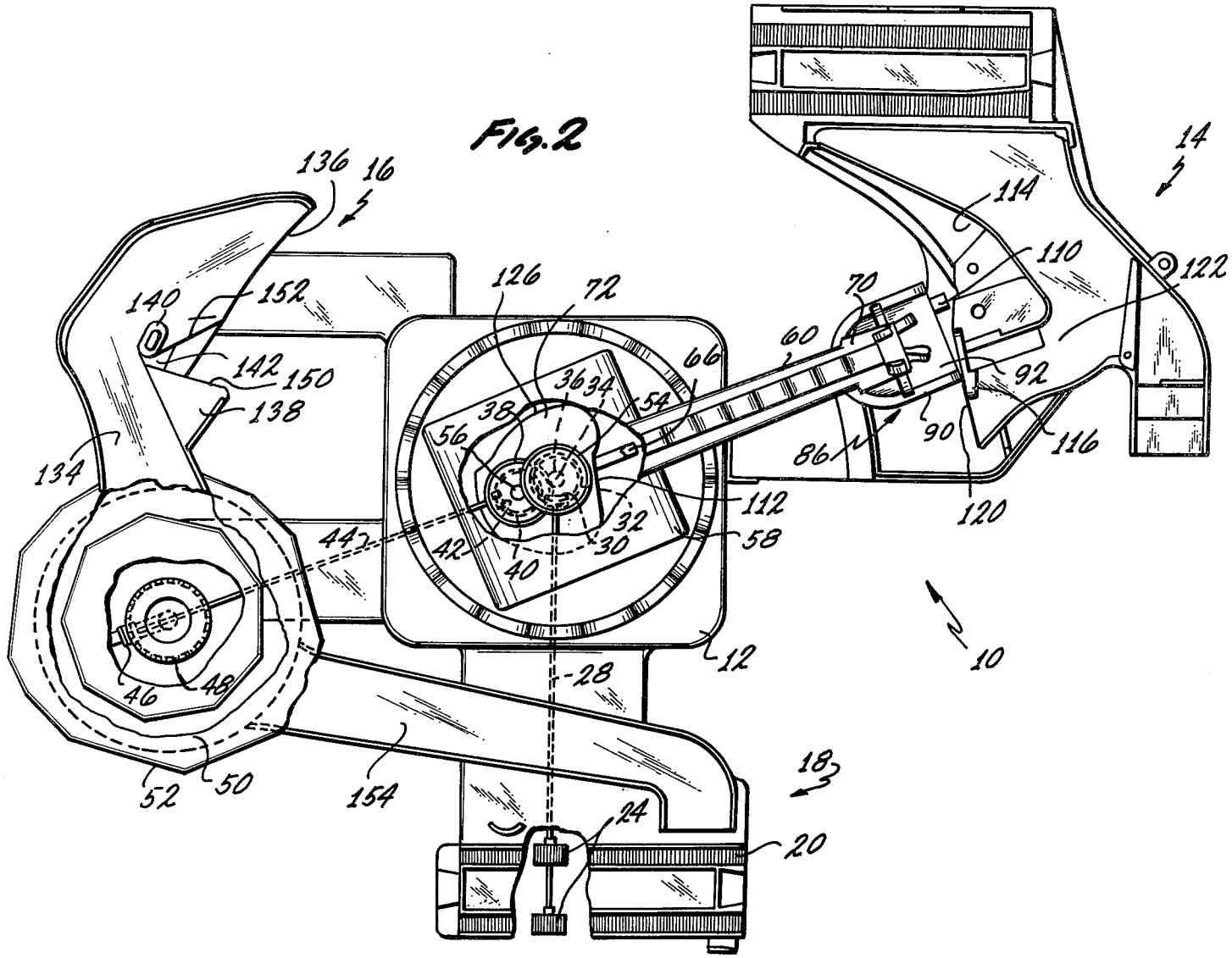
FIG. 2 is a top plan view in partial section of the components shown in FIG. 1.

For the purposes of illustration the edge 136 is shown as a slightly curved edge. However, the toy 10 would also function properly if this edge 136 were also a straight edge or a convex curve instead of a concave curve showing. In any event, however, as shown in FIG. 2 to the left of edge 136 is a small outwardly projecting triangular shaped member 138 integrally formed with platform 134. When article holding member 86 descends as a result of interaction of cam follower 66 against surface 130 a portion of the bottom of flat bottom surface 88 as well as the engagement lip 110 come to rest on the top of triangular member 138. Located clockwise from triangular member 138 is an upstanding frustrum 140. Immediately starting at the base of the frustrum 140 is a triangular cutout section 142. Located below the cutout section 142 is an extension of the lower flange 144 which together with upper flange 146 forms a guide channel 148. Upper flange 146 is in reality a portion of platform 134 and the outermost extension of flange 146 is edge 136.

Engagement lip 110 is held by gravity against triangular member 138. If in fact triangular member 138 was removed interaction of cam follower 66 with surface 132 would allow the article holding member 86 and the engagement lip 110 to descend a short distance further in a downward direction. Continued clockwise movement of the upright housing 58 about base 12 results in engagement lip 110 sliding across triangular member 138 until it passes edge 150 of the triangular member 138. At this time the engagement lip 110 descends through the cutout section 142. Frustrum 140 ensures that the ball person 100, at this time located within the article holding member 86, is not prematurely ejected from the article holding member 86 prior to correct alignment of the edge or portion 99 of flat bottom surface 88 with edge 136.

FIGS. 3, 4, 5 and 6 in sequence show the continued clockwise rotation engages the engagement lip 110 in guide channel 148. The wall 152 of guide channel 148 immediately below frustrum 140 projects obliquely to edge 136. This forces engagement lip 110 inwardly toward base 12 causing the article holding member 86 to pivot until the flat surface 88 passes through a horizontal position and the opening 92 is downwardly oriented. Further movement of the engagement lip 110 along the guide channel 148 is made while the opening 92 is downwardly oriented. This allows the ball person 100 located within the article holding member 86 to roll out of the article holding member 86 through opening 92 onto the surface of platform 134. During travel of the engagement lip 110 in guide channel 148 the flat bottom surface 88 is correctly aligned with edge 136 to allow smooth transfer of the ball person 100 out of the article holding member 86.

After being located on the platform 134 the ball person 100 travels down inclined ramp 134 to the transfer table 50. From the transfer table 50 the ball person 100 is deposited onto inclined ramp 154 and from there to vehicle 22. At this point in time the presence of the ball person 100 on the vehicle 22 causes the vehicle 22 to disengage from the third platform 18 and go around track 20 until it engages unloading platform 16 at which time it discharges its ball person 100 as per the mechanism described in the patents noted above.

After depositing its ball person 100 the article holding member 86 continues traveling about the unloading platform 16 and further rotation of the upright housing 58 then locates the article holding member 86 in position with the loading platform 14 as previously described.

I claim:

1. A transfer mechanism for moving an article from a first location to a second location which comprises:

a stationary base radially displaced from both said first and said second locations;

article carrier means rotatably mounted on said base such that at least a portion of said article carrier means is capable of moving from said first location to said second location, both of said locations being spaced from said base, said article carrier means including a support member, an article holding member and pivot means connecting said support and article holding members;

said support member having a first end arcuately movable through an arc from a position adjacent to said first location to a position adjacent to said second location;

said article holding member including a surface capable of supporting said article within said article holding member, said article carrier means further including a wall means projecting upwardly from said surface, said wall means capable of maintaining said article on said surface, said wall means including an opening through said wall means, said opening located over a position of said surface, said opening sized to allow said article to roll through said opening over said portion of said surface onto and off of said surface;

said pivot means pivotally attaching said article holding member to said first end of said support member so that said portion of said surface below said opening is movable toward and away from said second location when said support member is adjacent to said second location;

a stationary platform located at said second location, said platform including a stationary edge at least a portion of said edge being capable of engaging said article holding member during rotation of said support member;

engagement means on said article holding member for engaging said edge, said means operatively engaging said edge as said first end of said support member moves adjacent to said second location so as to pivot said article holding member about said pivot means so as to incline said surface so as to move said portion of said surface below said opening lower than the remainder of said surface so that an article will roll off of said surface through said opening onto said platform.

2. The transfer mechanism of claim 1 including:

guide means located along at least said portion of said edge and capable of guiding said engagement means along said portion of said edge in response to movement of said article holding means with respect to said edge as said support member arcuately moves adjacent to said second location.

3. The transfer mechanism of claim 1 including:

drive means operatively associated with said base and capable of rotating said article carrier means on said base.

4. The transfer mechanism of claim 3 wherein:

said article carrier means includes an upright member, said upright member rotatably mounted on said base and movable in response to said drive means;

said support member including a second end distal from said first end, said second end pivotally mounted to said upright member allowing said support member to pivot about said upright member so as to displace said first end vertically with respect to said base as said support member pivots.

5. The transfer mechanism of claim 4 wherein:

said article holding member is pivotally mounted proximal to its uppermost extremity and said surface is vertically displaced below said uppermost extremity such that said surface swings below said pivot means in an arcuate manner allowing said surface to lie in a horizontal plane in a first position and to move to at least a second position wherein said surface is displaced from said horizontal plane.

6. The transfer mechanism of claim 5 wherein:

said guide means comprises a channel means located on said edge, said channel means including an opening directed toward said base;

said engagement means comprises an engagement lip located below said surface and capable of operatively engaging said channel means such that when said channel engagement means engages said channel means said surface is displaced from said horizontal position allowing said article to slide off of said surface onto said platform.

7. The transfer mechanism of claim 6 including:

a cam means located in said upright member;

a cam follower means located on said second end of said support member, said cam follower means in operative engagement with said cam means such that said first end of said support member is movable about a vertical displacement as said cam follower means moves about said cam means.

8. The transfer mechanism of claim 7 wherein:

said wall means comprises an upstanding U shaped wall, said opening comprises said break between the ends of said U shaped wall; and suspension means interspaced between the uppermost surface of said U shaped wall and said pivot means to suspend said U shaped wall and said surface from said pivot means;

said article holding member pivoting about said pivot means such that said opening is slightly upwardly oriented when said article is located on said support proximal to said curved portion of said U shaped wall and said opening is slightly downwardly oriented when said engagement lip operatively engages with said channel means.

9. The transfer mechanism of claim 8 including:

limit means located on said first end of said support member limiting the arc of travel of said suspension means.

10. The transfer mechanism of claim 9 wherein:

said article comprises a figurine constructed so as to include a body and a ball carried by said body and extending from the lower extremity thereof, said ball being capable of rotating with respect to said body and serving as a wheel means enabling said figurine to move across said flat surface and to be expelled by gravity from said article holding member when said flat surface is displaced from said horizontal position and said opening is slightly downwardly oriented.

* * * * *